United States Patent [19]

Bokisa et al.

[11] Patent Number: 4,885,064

[45] Date of Patent: Dec. 5, 1989

[54] ADDITIVE COMPOSITION, PLATING BATH AND METHOD FOR ELECTROPLATING TIN AND/OR LEAD

[75] Inventors: George S. Bokisa, Fairview Park; Billie J. Page, Cleveland Hts., both of Ohio

[73] Assignee: McGean-Rohco, Inc., Cleveland, Ohio

[21] Appl. No.: 355,409

[22] Filed: May 22, 1989

[51] Int. Cl.[4] ..... C25D 3/32; C25D 3/36; C25D 3/56; C25D 3/60

[52] U.S. Cl. ..... 204/44.4; 204/53; 204/54.1; 204/DIG. 2

[58] Field of Search ..... 204/44.4, 53, 54.1, 204/DIG. 2

[56] References Cited

U.S. PATENT DOCUMENTS

| | | | |
|---|---|---|---|
| 2,313,371 | 3/1943 | Stack et al. | 204/54.1 |
| 2,525,942 | 10/1950 | Proell | 204/46.1 |
| 3,785,939 | 1/1974 | Hsu | 204/44.4 |
| 3,875,029 | 4/1975 | Rosenberg et al. | 204/44.4 |
| 3,905,878 | 9/1975 | Dohi et al. | 204/44.4 |
| 3,984,291 | 10/1976 | Lerner et al. | 204/44.4 |
| 4,072,582 | 2/1978 | Rosenberg | 204/54.1 |
| 4,132,610 | 1/1979 | Dohi et al. | 204/44.4 |
| 4,135,991 | 1/1979 | Canaris et al. | 204/44.4 |
| 4,139,425 | 2/1979 | Eckles et al. | 204/44.4 |
| 4,459,185 | 7/1984 | Obata et al. | 204/44.4 |
| 4,582,576 | 4/1986 | Opaskar et al. | 204/44.4 |
| 4,617,097 | 10/1986 | Nobel et al. | 204/44.4 |
| 4,662,999 | 5/1987 | Opaskar et al. | 204/44.4 |

*Primary Examiner*—G. L. Kaplan

*Attorney, Agent, or Firm*—Renner, Otto, Boisselle & Sklar

[57] ABSTRACT

It now has been found that a smooth, level, matte and/or bright deposit of tin, lead or tin-lead alloy can be deposited on a substrate from an aqueous plating bath which comprises (A) at least one bath-soluble metal salt selected from the group consisting of a stannous salt, a lead salt, or a mixture of stannous and lead salts; and (B) at least one alpha-acetylenic alcohol or glycol of the formula $$R_1R_2C(OH)C{\equiv}CR_3 \quad (I)$$

wherein $R_1$ and $R_2$ are each independently H, an alkyl group, a cycloalkyl group or $R_1$ and $R_2$ together with the carbon atom form a cyclic group, provided that at least one of $R_1$ and $R_2$ is an alkyl group containing at least three carbon atoms, and $R_3$ is H, an alkyl group or —C(OH)$R_1R_2$.

Preferably the plating baths do not contain fluoride or fluoborate ions, and the baths are also free of strong inorganic acids such as sulfuric acid.

29 Claims, No Drawings

ADDITIVE COMPOSITION, PLATING BATH AND METHOD FOR ELECTROPLATING TIN AND/OR LEAD

BACKGROUND OF THE INVENTION

This invention relates to the electrodeposition of tin, lead, and tin-lead alloys, and more particularly to a plating bath which deposits smooth, level, matte and/or bright tin and/or lead coatings.

Aqueous acidic plating baths for depositing tin and/or lead coatings on substrates have been known in the art, and most of these baths contain, in addition to the water-soluble tin and/or lead salts, fluoborates, fluosilicates, sulfates, sulfamates, etc. Plating baths containing fluoborate have been used widely to permit high-speed, uniform metal plating of tin, lead or tin-lead alloys.

In addition to the basic ingredients, the prior art has suggested improvements in tin and/or lead plating baths by including additives which will improve on the brightness of the deposit obtained from such baths. For example, in U.S. Pat. No. 3,875,029, the use of naphthalene monocarboxaldehyde either alone or in combination with certain substituted olefins described in the patent results in an improvement in the brightness of the deposit. Other ingredients which have been suggested as being useful additives in tin and/or lead plating baths include various combinations of aldehydes, ketones, nonionic surfactants, and amines. U.S. Pat. No. 4,135,991 describes tin, lead or tin-lead plating baths containing fluoborates and certain alkoxylated amines which are cationic surfactants as brighteners. The baths also contain an aromatic amine such as aniline. The plating bath described in U.S. Pat. No. 3,785,939 for producing bright deposits of tin-lead alloys comprises a combination of a nonionic polyoxyalkylated surfactant, a lower aliphatic aldehyde, an aromatic aldehyde, and an amine.

More recently, plating bath formulations have been suggested which provide for the deposition of tin and/or lead coatings wherein the baths contain no fluoborates. For example, U.S. Pat. No. 4,459,185 describes a plating bath which is prepared by adding one or more specified cationic, amphoteric and/or nonionic surfactants and one or more leveling agents to a principal plating bath which contains an alkane sulfonic or alkanol sulfonic acid and either a divalent tin salt or a divalent lead salt of the sulfonic acids or a mixture of these. The patentees suggest that the performance of such plating baths is comparable or even superior to plating baths containing borofluoride. The plating baths contain certain specified surfactants which may be cationic surfactants, amphoteric surfactants, or nonionic surfactants. The smoothness of the coating is improved by the synergistic effect obtained by the combination of the specified surfactants and certain leveling agents. A variety of leveling agents including benzaldehyde derivatives is described in the patent.

Tin-lead alloy plating baths including hydroxyalkyl sulfonic acids are described in U.S. Pat. No. 4,132,610. The baths do not contain fluoborates or phenol sulfonates, but do contain the reaction product of o-toluidine with acetaldehyde as a brightener.

U.S. Pat. No. 3,905,878 describes tin-lead plating baths containing at least one sulfonate salt of tin and lead as well as free phenolsulfonic acid and/or free cresolsulfonic acid. Additionally, the plating baths contain a brightening agent which is prepared by reacting an aliphatic aldehyde with an aromatic primary amine under alkaline conditions. The plating baths also contain acetaldehyde and, optionally, surface-active agents.

U.S. Pat. No. 4,072,582 describes tin plating baths containing dialkoxy benzaldehydes, emulsifying agents and alpha,beta-unsaturated carboxylic acids, amides and esters for producing bright tin deposits. The tin is introduced into the bath as stannous sulfate, and sulfuric acid is included in the baths.

Tin or tin and lead plating baths containing aromatic sulfones and mono- and polysulfonic acids of benzene, phenol and cresol are described in U.S. Pat. No. 2,313,371 and British Pat. No. 555,929. The aromatic sulfonic acids form soluble salts of tin and lead, and the disulfonic acids are particularly preferred because they provide extremely soluble salts.

U.S. Pat. No. 3,984,291 describes a plating bath which does not contain any fluoride or fluoborate. These plating baths are based on pyrophosphate and Rochelle salts. The bath is prepared, for example, by dissolving stannous pyrophosphate, potassium pyrophosphate and Rochelle salts (NaK tartrate) together with a lead salt such as lead tartrate or lead pyrophosphate in water. Generally, these types of electrolytic baths are operated at a pH of from 8.0 to 10.

Electroplating baths containing an alkane sulfonate ion wherein the alkyl group contains between 1 and 5 carbon atoms are described in U.S. Pat. No. 2,525,942. The sulfonate ions are the principal or sole anions in the plating bath. The metallic ions contained in the electrochemical baths may be lead, nickel, chromium, copper, zinc, iron, cobalt, cadmium and silver. The baths are described as being especially suitable for the electroplating of lead and nickel.

Tin, lead and tin-lead plating baths which are free of fluorine and fluoborate ions and which contain at least one alkane sulfonic acid or alkanolsulfonic acid are described in U.S. Pat. Nos. 4,582,576 and 4,662,999. The baths also contain brightening agents and surfactants. Among the nonionic surfactants disclosed in both patents are the ether-containing surfactants obtained by reacting alcohols with excess ethylene or propylene oxide. Specific examples of such surfactants are Surfynol 465, a product obtained by reacting about 10 moles of ethylene oxide with one mole of tetramethyldecynediol, and Surfynol 485, obtained by reacting about 30 moles of ethylene oxide with the same diol.

SUMMARY OF THE INVENTION

It now has been found that a smooth, level, matte and/or bright deposits of tin, lead or tin-lead alloy can be deposited on a substrate from an aqueous plating bath which comprises (A) at least one bath-soluble metal salt selected from the group consisting of a stannous salt, a lead salt, or a mixture of stannous and lead salts; and (B) at least one alpha-acetylenic alcohol or glycol of the formula $$R_1R_2C(OH)C{\equiv}CR_3 \qquad (I)$$

wherein $R_1$ and $R_2$ are each independently H, an alkyl group, a cycloalkyl group or $R_1$ and $R_2$ together with the carbon atom form a cyclic group, provided that at least one of $R_1$ and $R_2$ is an alkyl group containing at least three carbon atoms, and $R_3$ is H, an alkyl group or —C(OH)$R_1R_2$.

Preferably the plating baths do not contain fluoride or fluoborate ions, and the baths are also free of strong inorganic acids such as sulfuric acid.

DESCRIPTION OF THE PREFERRED EMBODIMENTS

The plating baths of the present invention comprise tin ions, lead ions or a mixture of tin and lead ions, and at least one alpha-acetylenic alcohol or glycol. The tin and/or lead ions are introduced as bath-soluble salts. In one embodiment, the plating baths also may contain ions selected from the group consisting of fluoborates, fluosilicates, sulfamates and mixtures thereof. Such baths can be prepared, for example, utilizing stannous fluoborate, lead fluoborate, or mixtures thereof together with fluoboric acid and boric acid.

In one preferred embodiment, the plating baths of the invention contain no fluoride or fluoborate ions, and the plating baths also are generally free of strong inorganic acids such as sulfuric acid. In this preferred embodiment, the plating baths are prepared from tin and/or lead salts of alkane sulfonic acid, and the baths also contain free alkane sulfonic acid or alkanol sulfonic acids as defined more fully below.

The particular metal ion included in the plating baths of the invention will depend upon the type of deposit desired. Thus, if a tin deposit is desired, the plating bath will not contain any lead, and if a lead deposit is desired, the bath will not contain any tin. Obviously when a tin-lead alloy is desired, the bath will contain both tin and lead ions. The total concentration of metal ion or ions in the bath may vary over a wide range depending on the desired properties of the plating to be deposited on the substrate. Generally, from about 0.5 to about 350 grams per liter or more of the metal ion or ions are included in the bath, and more generally, the bath will contain from about 6 to about 100 grams per liter of metal ion or ions.

The alpha-acetylenic alcohols and glycols which are utilized in the plating baths of the present invention are characterized by the general formula $$R_1R_2C(OH)C{\equiv}CR_3 \qquad (I)$$

wherein $R_1$ and $R_2$ are each independently H, an alkyl group, a cycloalkyl group or $R_1$ and $R_2$ together with the carbon atom form a cyclic group, provided that at least one of $R_1$ and $R_2$ is an alkyl group containing at least three carbon atoms, and $R_3$ is H, an alkyl group or —C(OH)$R_1R_2$.

Generally, $R_1$ and $R_2$ are lower alkyl groups containing from 1 to about 7 carbon atoms. Examples of such alkyl groups include methyl, ethyl, n-propyl, i-propyl, n-butyl, i-butyl, n-amyl, i-amyl, n-hexyl, etc. The cycloalkyl groups will contain 4 or more carbon atoms, and more often will contain 6 to 7 carbon atoms.

In one preferred embodiment, the plating baths of the present invention contain alpha-acetylenic glycols which may be represented by the formula $$R_1R_2C(OH)C{\equiv}C{-}C(OH)R_1R_2 \qquad (IA)$$

$R_1$ and $R_2$ are each independently hydrogen, alkyl groups, cycloalkyl groups or $R_1$ and $R_2$ together with the carbon atom to which they are attached may form a cyclic group provided that at least one of $R_1$ and $R_2$ is an alkyl group containing at least three carbon atoms. Preferably, $R_1$ and $R_2$ are lower alkyl groups such as defined with respect to Formula I. Symmetrically substituted glycols of Formula IA are most preferred. That is, both $R_1$ groups in Formula IA are the same and both $R_2$ groups in Formula IA are the same.

Specific examples of acetylenic alcohols and glycols of the type represented by Formula I include 2-propyne-1-ol(propargyl alcohol), 3,5-dimethyl-1-hexyne-3-ol and 2,4,7,9-tetramethyl-5-decyne-4,7-diol which are available commercially from Air Products and Chemicals, Inc. under the designations "Surfynol 61" and "Surfynol 104", respectively.

The alpha-acetylenic alcohols and glycols utilized in the plating baths of the present invention are soluble in the plating baths. The amount of acetylenic alcohol or glycol included in the plating bath of the present invention may be varied over a wide range although amounts of from about 1 to about 10 grams per liter are generally satisfactory. The acetylenic alcohols are included in the plating baths in amounts sufficient to reduce the tendency of the plating bath to foam while allowing good alloy distribution. Foaming the tin, lead and tin-lead plating baths, particularly plating baths which are free of fluoride and fluoborate ions is often a problem to strip line platers who utilize constantly cascading baths. Foaming is an undesirable characteristic of electroplating baths because the foam tends to remove solution from the plating apparatus, and the foam often is corrosive to metal. Also, it has been discovered that the addition of the above-described alpha-acetylenic alcohols and glycols to the tin and lead plating baths of the invention does not interfere with the alloy distribution in non-fluoride and non-fluoborate tin-lead plating baths.

The plating baths of the present invention also may contain, and preferably do contain (C) at least one surfactant. The surfactants include nonionic, cationic, anionic or amphoteric surfactants. In one embodiment, the plating baths of the present invention will contain at least one cationic surfactant and more particularly at least one cationic surfactant and at least one anionic surfactant.

The cationic surfactants useful in the plating baths of the present invention may be selected from the group consisting of higher alkyl amine salts, quaternary ammonium salts, alkyl pyridinium salts and alkyl imidazolium salts.

Cationic surfactants obtained by condensation of various amounts of ethylene oxide or propylene oxide with primary fatty amines are useful and may be represented by the following formula

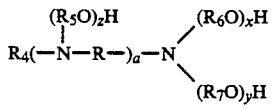

(II)

wherein $R_4$ is a fatty alkyl group containing about 8 to about 22 carbon atoms;

R is an alkylene group containing up to about 5 carbon atoms;

$R_5$, $R_6$ and $R_7$ are each independently an ethylene or propylene group;

a is 0 or 1; and x, y and z are each independently integers from 1 to about 30, and the sum of x, y and z is from 2 to about 50.

More particularly, the alkoxylated amines utilized in the baths of the invention are represented by the Formulae IIA and IIB.

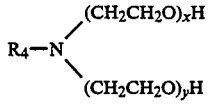

(IIA)

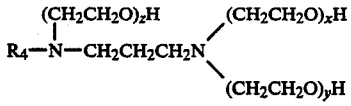

(IIB)

wherein $R_4$ is a fatty alkyl group containing from 12 to 18 carbon atoms; and x, y and z are as defined in Formula II.

The above described cationic surfactants are known in the art and are available from a variety of commercial sources. The surfactants of the type represented by Formula IIA can be prepared by condensing various amounts of ethylene oxide with primary fatty amines which may be a single amine or a mixture of amines such as are obtained by the hydrolysis of tall oils, sperm oils, coconut oils, etc. Specific examples of fatty amines containing from 8 to 22 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The alkoxylated amines which are useful in the plating baths of the invention can be prepared as mentioned above, by condensing alkylene oxides with the above-described primary amines by techniques known to those in the art. A number of such alkoxylated amines is commercially available from a variety of sources.

The above-described amines can be prepared, as mentioned above, by condensing alkylene oxides with the above-described primary amines by techniques known to those in the art. Such alkoxylated amines are commercially available from a variety of sources. The alkoxylated amines of the type represented by Formula IIA are available from the Armak Chemical Division of Akzona, Inc., Chicago, Illinois, under the general trade designation "Ethomeen". Specific examples of such products include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide respectively; "Ethomeen S/15" and "S/20" which are ethylene oxide condensation products with stearyl amine containing about 5 and 10 moles of ethylene oxide per mole of amine respectively; and "Ethomeen T/15" and "T/25" which are ethylene oxide condensation products of tallow amine containing about 5 and 15 moles of ethylene oxide per mole of amine respectively. Commercially available examples of the alkoxylated amines of the type represented by Formula IIB include "Ethoduomeen T/13" and "T/20" which are ethylene oxide condensation products of N-tallow trimethylene diamine containing about 3 and 10 moles of ethylene oxide per mole of diamine respectively.

Another type of useful cationic surfactant is represented by the formula

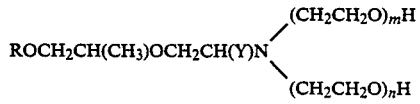

(IIC)

wherein

R is an alkyl group containing from about 8 to about 12 carbon atoms;

Y is a methyl or a hydroxyl group; m and n are integers, the sum of which is from about 2 to about 20.

The amine ethoxylate surfactants of the type represented by Formula IIC exhibit the characteristics of both cationic and nonionic surfactants with the nonionic properties increasing at the higher levels of ethyoxylation. That is, as the sum of x and y increases, the ethoxylated amine behaves more like a nonionic surfactant.

The surfactants represented by Formula IIC wherein Y is a methyl group are available commercially such as from Texaco Chemical Company under the trade designation "M-300 Series". The M-300 Series compounds currently available from Texaco and which have been found to be useful in the aqueous acid plating baths of the invention include those designated as M-302, M-305, M-310, M-315 and M-320 which contain a total of 2, 5, 10, 15 and 20 moles of ethylene oxide respectively. In all of these compounds, R is a mixture of 10 and 12 carbon alkyl groups.

The cationic surfactant also may be various nitrogen salt compounds such as (a) quaternary ammonium salts of the formula

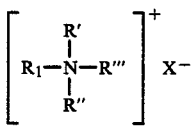

(III)

wherein

X represents a halogen, a hydroxyl group, or the residue of a $C_{1-5}$ alkanesulfonic acid;

$R_1$ represents a $C_{8-20}$ alkyl group;

R' and R'' represent a $C_{1-4}$ alkyl group; and

R''' represents a $C_{1-10}$ alkyl group or a benzyl group;

(b) pyridinium salts represented by the general Formula IV

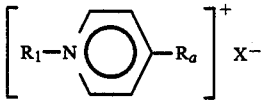

(IV)

wherein

X represents a halogen, a hydroxyl group, or the residue of a $C_{1-5}$ alkanesulfonic acid;

$R_1$ represents a $C_{8-20}$ alkyl group; and $R_a$ represents hydrogen or a $C_{1-4}$ alkyl group;

(c) imidazolinium salts represented by the general Formula V

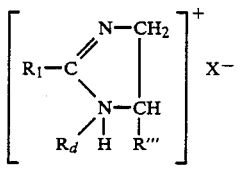

(V)

wherein

X represents a halogen, a hydroxyl group, or the residue of a $C_{1-10}$ alkanesulfonic acid;

$R_1$ represents a $C_{8-20}$ alkyl group;

$R_d$ represents a hydroxy-containing $C_{1-5}$ alkyl group; and

R''' represents a $C_{1-10}$ alkyl group or a benzyl group; and (d) higher alkyl amine salts represented by the general formula $$[R_1—NH_3]^+CH_3(CH_2)_nCOO^- \quad (VI)$$

wherein $R_1$ represents a $C_{8-20}$ alkyl group; and n is from about 0 to about 4.

Examples of the above-described cationic surfactants, in the form of salts, are lauryltrimethylammonium salt, cetyltrimethylammonium salt, stearyltrimethylammonium salt, lauryldimethylethylammonium salt, octadecyldimethylethylammonium salt, dimethylbenzyllaurylammonium salt, cetyldimethylbenzylammonium salt, octadecyldimethylbenzylammonium salt, trimethylbenzylammonium salt, triethylbenzylammonium salt, hexadecylpyridinium salt, laurylpyridinium salt, dodecylpicolinium salt, hexadecylpyridinium salt, laurylpyridinium salt, dodecylpicolinium salt, 1-hydroxyethyl-1-benzyl-2-laurylimidazolinium salt, 1-hydroxyethyl-1-benzyl-2-oleylimidazolinium salt, stearylamine acetate, laurylamine acetate, and octadecylamine acetate.

The above cationic surfactants, and in particular the amine alkylene oxide condensation products of Formulae II, IIA, IIB and IIC are useful as brightening agents and grain refining components of the plating baths of this invention.

The surfactants included in the plating baths also may be anionic surfactants. Examples of useful anionic surfactants include sulfated alkyl alcohols, sulfated lower ethoxylated alkyl alcohols, and their salts such as alkali metal salts. Specific examples of useful anionic surfactants include sodium alkyl alcohol sulfates such as "Duponol SP", a sodium alkyl alcohol sulfate from DuPont and Tergitol 08 from Union Carbide. Plating baths of the present invention which contain a combination of cationic surfactants such as an alkoxylated amine represented by Formulae IIA or IIB and an alkali metal salt of a sulfated alkyl alcohol provide especially desirable tin-lead deposits.

The nonionic surfactants which can be utilized in the present invention include the condensation products of ethylene oxide and/or propylene oxide with compounds containing a hydroxy, mercapto or amino group containing at least one N-H. Examples of materials containing hydroxyl groups include alkyl phenols, styrenated phenols, fatty alcohols, fatty acids, polyalkylene glycols, etc. Examples of materials containing amino groups include alkylamines and polyamines, fatty acid amides, etc.

Examples of nonionic surfactants useful in the plating baths of the invention include ether-containing surfactants having the formula $$R—O—[(CH_2)_nO]_xH \quad (VII)$$

wherein R is an aryl or alkyl group containing from about 6 to 20 carbon atoms, n is 2 or 3, and x is an integer between 2 and 100. Such surfactants are produced generally by treating fatty alcohols or alkyl or alkoxy-substituted phenols or naphthols with excess ethylene oxide or propylene oxide. The alkyl carbon chain may contain from about 14 to 24 carbon atoms and may be derived from a long chain fatty alcohol such as oleyl alcohol or stearyl alcohol.

Nonionic polyoxyethylene compounds of this type are described in U.S. Pat. No. 3,855,085. Such polyoxyethylene compounds are available commercially under the general trade designations "Surfynol" by Air Products and Chemicals, Inc. of Wayne, Pennsylvania, and under the designation "Pluronic" or "Tetronic" by BASF Wyandotte Corp. of Wyandotte, Michigan. Examples of specific polyoxyethylene condensation products useful in the invention include "Surfynol 465" which is a product obtained by reacting about 10 moles of ethylene oxide with 1 mole of tetramethyldecynediol. "Surfynol 485" is the product obtained by reacting 30 moles of ethylene oxide with tetramethyldecynediol. "Pluronic L35" is a product obtained by reacting 22 moles of ethylene oxide with polypropylene glycol obtained by the condensation of 16 moles of propylene oxide.

Alkoxylated amine, long chain fatty amine, long chain fatty acid, alkanol amines, diamines, amides, alkanol amides and polyglycol-type surfactants known in the art are also useful. One type of amine surfactant found particularly useful in a tin or lead plating bath is the group obtained by the addition of a mixture of propylene oxide and ethylene oxide to diamines. More specifically, compounds formed by the addition of propylene oxide to ethylene diamine followed by the addition of ethylene oxide are useful and are available commercially from BASF Wyandotte Ind. Chemical Group under the general trade designation "Tetronic".

Carbowax-type surfactants which are polyethylene glycols having different molecular weights also are useful. For example, Carbowax No. 1000 has a molecular weight range of from about 950 to 1050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as surfactants in the compositions of the invention.

Ethylene oxide condensation products with fatty acids also are useful nonionic surfactants. Many of these are available commercially such as under the general tradename "Ethofat" from Armak Ind. Examples include condensate of coco acids, oleic acid, etc. Ethylene oxide condensates of fatty acid amides, e.g., oleamide, also are available from Armak Inc.

In some of the baths, improved results are obtained when polyoxyalkylated glycols, phenols and/or naphthols are included. For example, ethylene oxide and propylene oxide condensates with aliphatic alcohols, sorbitan alkyl esters, alkyl, alkoxy and styrenated phenols and naphthols are useful additives. About 6 to about 40 moles of the oxide may be condensed with the above-identified compounds. Many of these condensates are available commercially under such tradenames as "Tween" from ICI America, "Triton" from Rohm & Haas Co., "Tergitol" from Union Carbide, and "Igepal" from General Aniline and Film Corp.

The surfactants (C) utilized in the plating baths of the present invention may be amphoteric surfactants. The preferred amphoteric surfactants include betaines and sulfobetaines, and sulfated or sulfonated adducts of the condensation products of ethylene oxide and/or propylene oxide with an alkyl amine or diamine. The betaines may be represented by the general formula

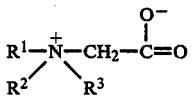

(VIII)

wherein $R^1$ is an alkyl group containing from about 8 to 20 carbon atoms, and $R^2$ and $R^3$ are alkyl groups containing from 1 to about 4 carbon atoms.

Typical betaines include lauryldimethylammonium betaine and stearyl dimethylammonium betaine. Sulfated and sulfonated adducts include Triton QS-15 (Rohm & Haas Co.), a sulfated adducct of an ethoxylated alkylamine, Miranol HS, a sodium salt of a sulfonated lauric derivative, Miranol OS, a sodium salt of a sulfonated oleic acid, etc.

The surfactants (C) described above may be used in the plating baths of the present invention in concentrations of from about 0.01 to about 50 grams per liter of bath. More preferably, the concentration of the surfactants in the plating baths of the invention will be from about 0.05 to about 30 grams per liter of bath.

In one embodiment of the present invention, particularly when the plating baths are free of fluoride and fluoborate ions, the plating baths also may contain at least one alkane sulfonic acid or alkanol sulfonic acid.

The alkane sulfonic acids (E) that can be utilized in the present invention have the following formula $$RSO_3H \quad \text{(IX)}$$

wherein R is an alkyl group containing from about 1 to about 12 carbon atoms and more preferably, from about 1 to 6 carbon atoms. Examples of such alkane sulfonic acids include, for example, methane sulfonic acid, ethane sulfonic acid, propane sulfonic acid, 2-propane sulfonic acid, butane sulfonic acid, 2-butane sulfonic acid, pentane sulfonic acid, hexane sulfonic acid, decane sulfonic acid and dodecane sulfonic acid. The individual alkane sulfonic acids or mixtures of any of the above alkane sulfonic acids can be utilized in the plating baths of the invention.

The alkanol sulfonic acids (E) which are useful in the present invention are characterized by the following formula $$C_nH_{2n+1}-\underset{\underset{OH}{|}}{CH}-(CH_2)_m-SO_3H \quad \text{(X)}$$

wherein n is from 0 to about 10, m is from 1 to about 11 and the sum of m+n is up to about 12. As can be seen from the above Formula X, the hydroxy group may be a terminal or internal hydroxy group. Examples of useful alkanol sulfonic acids include 2-hydroxy ethyl-1-sulfonic acid, 1-hydroxy propyl-2-sulfonic acid, 2-hydroxy propyl-1-sulfonic acid, 3-hydroxy propyl-1-sulfonic acid, 2-hydroxy butyl-1-sulfonic acid, 4-hydroxy-pentyl-1-sulfonic acid, 2-hydroxy-hexyl-1-sulfonic acid, 2-hydroxy decyl-1-sulfonic acid, 2-hydroxy dodecyl-1-sulfonic acid.

The alkane sulfonic acids and alkanol sulfonic acids are available commercially and can also be prepared by a variety of methods known in the art. One method comprises the catalytic oxidation of mercaptans or aliphatic sulfides having the formula $$R_1S_nR_2$$

wherein $R_1$ or $R_2$ are alkyl groups and n is a positive integer between 1 and 6. Air or oxygen may be used as the oxidizing agent, and various nitrogen oxides can be employed as catalysts. The oxidation generally is effected at temperatures below about 150° C. Such oxidation processes are described and claimed in U.S. Pat. Nos. 2,433,395 and 2,433,396. Alternatively, chlorine can be used as the oxidizing agent.

When the plating bath is to be a fluoride-free tin plating bath, the bath generally will contain at least one alkane or alkanol sulfonic acid as described above and a tin salt thereof. Likewise, a fluoride-free lead plating bath contains at least one alkane or alkanol sulfonic acid and a lead salt thereof. Mixtures of said acids and salts are useful. The tin-lead alloy plating baths will contain at least one alkane or alkanol sulfonic acid and the tin and lead salts thereof. The divalent tin and divalent lead salts of alkane sulfonic acids and alkanol sulfonic acids can be readily prepared by the reaction of a divalent tin or divalent lead salt with the desired sulfonic acid. Examples of tin and lead salts which can be reacted with the sulfonic acid to form the desired metal sulfonate include the oxides of tin and lead.

The concentration of the free alkane or alkanol sulfonic acid (E) in the plating baths of the invention is in a range of from about 10 to about 500 grams per liter of bath, and more preferably from about 50 to about 200 grams per liter of bath.

Plating baths of the present invention also may contain an effective amount of at least one primary brightening agent which generally are aromatic aldehydes or ketones. The primary brightening agents are selected from the group consisting of aromatic aldehydes, acetophenones, and carbonyl compounds having the general formula $$Ar-C(H)=C(H)-C(O)-CH_3 \quad \text{(XI)}$$

wherein Ar is a phenyl, naphthyl, pyridyl, thiophenyl or furyl group.

The aromatic aldehydes may be the benzaldehydes, naphthaldehydes, pyridinecarboxaldehydes, thiophenecarboxaldehydes and furaldehydes.

Benzaldehydes include the derivatives represented by the formula

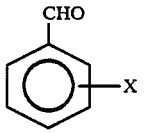

(XII)

wherein X is hydrogen or a nitro, halo, amino, alkoxy or lower alkyl group. Specific examples of benzaldehydes include benzaldehyde, o-chlorobenzaldehyde, tolualdehyde, cinnamaldehyde and anisaldehyde.

The acetophenones are characterized by the following Formula XIII

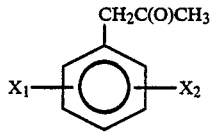

(XIII)

wherein $X_1$ and $X_2$ are each independently hydrogen and chlorine. Examples of such compounds are acetophenone and 3',4'-dichloroacetophenone.

In another preferred embodiment, the primary brightening agent is a carbonyl compound having the formula $$Ar—C(H)=C(H)—C(O)CH_3 \quad (XI)$$

wherein Ar is phenyl, naphthyl, pyridyl, thiophenyl or furyl group.

When Ar is a phenyl group, the carbonyl compound can be represented by the general formula XIV

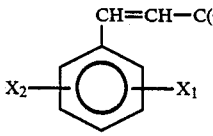

(XIV)

wherein $X_1$ and $X_2$ may be hydrogen, hydroxyl, alkoxy, chlorine or bromine, and the alkyl group of the alkoxy group may contain from about 1 to about 5 carbon atoms. Examples of such compounds include benzylidine acetone and 3'-chlorobenzylidine acetone.

The amount of the above-described primary brightening agents utilized in the plating baths of the present invention can range from about 0.05 to about 5 grams per liter of bath and more generally is within the range of from about 0.2 to about 1 gram per liter of plating bath.

Antioxidants normally used in tin, lead and tin/lead baths may be included in the baths of this invention. For example catechol (1,2-dihydroxybenzene) is useful as an antioxidant stabilizer in the baths and prevents air oxidation of stannous to stannic tin. Generally amounts of from about 0.05 to about 2 grams of antioxidant per liter of bath are sufficient.

The tin, lead, and tin-lead plating baths of the present invention, and in particular those which contain no fluoride or fluoborate ions, and preferably no sulfuric acid, deposit a bright level coating of the metal or alloy on substrates at any conventional temperature used or normally used with tin and/or lead plating baths, and over a wide current density range.

The following examples illustrate the plating baths of the invention. Unless otherwise indicated in the following examples and elsewhere in the specification and claims, all parts and percentages are by weight, and temperatures are in degrees Centigrade.

| | g/l |
|---|---|
| Example 1 | |
| Stannous ion (added as stannous methane sulfonate) | 30 |
| Free methane sulfonic acid | 100 |
| Ethomeen 18/20 (ethylene oxide condensation product of primary fatty amines) | 1.5 |
| Surfynol 104 | 2 |
| Water | to make 1 liter |
| Example 2 | |
| Stannous ion (added as stannous hydroxy ethane sulfonate) | 18 |
| Plumbous ion (added as plumbous hydroxy ethane sulfonate) | 3 |
| Free hydroxy ethane sulfonic acid | 120 |
| Miranol J2M-SF (amphoteric surfactant identified as a dicarboxylic caprylic derivative, disodium salt, salt free) | 3 |
| Surfynol 104 | 3 |
| Water | to make 1 liter |
| Example 3 | |
| Plumbous ion (added as plumbous ethane sulfonate) | 25 |
| Free ethane sulfonic acid | 200 |
| Sulfonic N 150 (nonylphenol condensed with 15 moles of ethylene oxide) | 4 |
| Surfynol 104 | 5 |
| Water | to make 1 liter |
| Example 4 | |
| Stannous ion (added as stannous methane sulfonate) | 20 |
| Plumbous ion (added as plumbous methane sulfonate) | 10 |
| Free methane sulfonic acid | 150 |
| Dupanol SP (sodium alcohol sulfate) | 3 |
| Catechol | 0.3 |
| Surfynol 104 | 4 |
| Water | to make 1 liter |
| Example 5 | |
| Stannous ion (added as stannous methane sulfonate) | 20 |
| Plumbous ion (added as plumbous methane sulfonate) | 2 |
| Free methane sulfonic acid | 150 |
| Acetophenone | 0.04 |
| Texaco M 315 | 3 |
| Ethoxylated beta-naphthol | 2 |
| Surfynol 10 | 2 |
| Water | to make 1 liter |
| Example 6 | |
| Stannous ion (added as stannous methane sulfonate) | 20 |
| Plumbous ion (added as plumbous methane sulfonate) | 10 |
| Free methane sulfonic acid | 150 |
| Acetaldehyde | 4 |
| Ethoxylated beta-naphthol | 8 |
| 2,5-dimethoxy benzaldehyde | 0.2 |
| Surfynol 104 | 2 |
| Water | to make 1 liter |
| Example 7 | |
| Stannous (added as stannous methane sulfonate) | 20 |
| Plumbous ion (added as plumbous methane sulfonate) | 2 |
| Free methane sulfonic acid | 100 |
| Texaco M 315 | 10 |
| Methacrylic acid | 0.5 |
| 2-hydroxy-1-naphthaldehyde | 0.06 |
| Surfynol 104 | 4 |
| Water | to make 1 liter |
| Example 8 | |
| Stannous ion (added as stannous | |

-continued

| | g/l |
|---|---|
| fluoborate) | 20 |
| Plumbous ion (added as plumbous fluoborate) | 10 |
| Free fluoboric acid | 200 |
| Boric acid | 15 |
| Sulfonic N 150 | 2 |
| Resorcinol | 5 |
| Surfynol 104 | 3 |
| Water | to make 1 liter |
| Example 9 | |
| Stannous ion (added as stannous fluoborate) | 20 |
| Plumbous ion (added as plumbous fluoborate) | 2 |
| Free fluoboric acid | 150 |
| Boric acid | 15 |
| Igepal CO-630 [nonylphenoxy poly-(ethylenoxy)-ethanol] | 4 |
| Surfynol 104 | 5 |
| Water | to make 1 liter |
| Example 10 | |
| Stannous ion (added as stannous fluoborate) | 20 |
| Plumbous ion (added as plumbous fluoborate) | 2 |
| Free fluoboric acid | 100 |
| Boric acid | 15 |
| Ethomeen 18/20 | 10 |
| Methyl acrylate | 2 |
| 2-naphthaldehyde | 0.1 |
| Surfynol 104 | 3 |
| Water | to make 1 liter |

The utility of the plating baths of the present invention in depositing tin, lead and tin-lead coatings is demonstrated by conducting plating tests in standard 267 ml Hull cells using as the anode, a tin or tin-lead alloy (60/40, tin/lead). Steel panels are plated at a current of 2 amps for a period of five minutes. Mechanical bath agitation is employed, and the bath temperature is maintained at about 20° C. to about 25° C. The results of the plating tests are summarized in the following table.

TABLE

| Example | Bath | Finish | Appearance of Hull Cell Panel |
|---|---|---|---|
| 1 | Sn | Matte | Uniform matte overall range |
| 3 | Pb | Matte | Non-uniform matte 80 ASF to 2 ASF, burn in HCD |
| 4 | 60/40 | Matte | Uniform matte 60 ASF to 2 ASF, no dendrites |
| 5 | 90/10 | Matte | Uniform matte over full range |
| 6 | 60/40 | Bright | Clear bright 100 ASF to 20 ASF, dull 30 ASF to 0 |
| 7 | 90/10 | Bright | Clear bright 80 ASF to 40 ASF, hazy bright 40 ASF to 12 ASF, dull to 2-ASF |
| 8 | 60/40 | Matte | Uniform matte 80 ASF to 9, burn in HCD |
| 9 | 90/10 | Matte | Uniform matte 80 ASF to 9, burn in HCD |
| 10 | 90/10 | Bright | Clear bright 100 ASF to 12 ASF, hazy bright 12 ASF to 2 ASF, dull to 0 |

The ability of the alpha acetylenic alcohols to reduce foaming in the plating baths is demonstrated by bubbling air through a 50 ml sample of the plating bath and observing foam formation. The incorporation of the alpha acetylenic glycols into the baths of Examples 1 and 3–10 eliminated the tendency of the baths to foam without changing the deposit characteristics.

In practice, the improved tin, lead, and tin-lead alloy plating baths of the invention may be operated on a continuous or intermittent basis, and from time to time, components of the bath have to be replenished. The various components may be added singularly as required, or they may be added in combination. The amounts of the various additive compositions to be added to the plating bath may be varied over a wide range depending on the nature and performance of the plating bath to which the composition is added. Such amounts can be determined readily by one skilled in the art.

Another aspect of this invention relates to additive compositions which may be mixtures of the compositions without any solvent or carrier, or they may be concentrates of bath components in water, alcohols (e.g., propanol or isopropanol) or mixtures of water and one or more alcohols. The additive composition will comprise at least one alpha-acetylenic alcohol or glycol of Formula I, and at least one or more of the additional bath components described above such as Ethomeen 18/20 and Dupanol SP dissolved in water or an isopropyl alcohol/water mixture. The concentrates also may contain alkane sulfonic acid or alkanol sulfonic acid and/or catechol. The amounts of the components in the various additive compositions or concentrates of the invention will be such that when they are diluted, they will provide the requisite amounts of the components in the plating bath or the requisite amounts of the components to replenish the bath.

The following additive compositions or concentrates illustrate some of the various combinations of components that can be prepared and utilized in accordance with the invention for preparing and/or maintaining the baths of the invention, and/or approving the performance of the baths of the invention. Other additives may be added individually or in other combinations of the baths.

| | %/Wt. |
|---|---|
| Additive Composition 1 | |
| Surfynol 104 | 5.0 |
| Dupanol SP | 2.8 |
| Isopropyl Alcohol | 40 |
| Water | 42.2 |
| Additive Composition 2 | |
| Surfynol 104 | 5.5 |
| Dupanol SP | 2.8 |
| Ethomeen 18/20 | 3.1 |
| Isopropyl Alcohol | 45.0 |
| Water | 43.6 |
| Additive Composition 3 | |
| Surfynol 104 | 6.0 |
| Dupanol SP | 3.0 |
| Ethomeen 18/20 | 3.2 |
| Catechol | 0.8 |
| Isopropyl Alcohol | 30 |
| 2-ethylhexanol | 10 |
| Water | 47.0 |
| Additive Composition 4 | |
| Surfynol 104 | 5.0 |
| Dupanol SP | 2.85 |
| Ethomeen 18/20 | 3.11 |
| Catechol | 0.76 |
| Isopropyl Alcohol | 40 |
| Water | 48.28 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. An aqueous plating bath for electrodeposition of tin, lead, or tin-lead alloys comprising (A) at least one bath-soluble metal salt selected from the group consisting of a stannous salt, a lead salt, or a mixture of stannous and lead salts; and (B) at least one alpha-acetylenic alcohol or glycol of the formula $$R_1R_2C(OH)C{\equiv}CR_3 \quad (I)$$

wherein $R_1$ and $R_2$ are each independently H, an alkyl group, a cycloalkyl group or $R_1$ and $R_2$ together with the carbon atom form a cyclic group, provided that at least one of $R_1$ and $R_2$ is an alkyl group containing at least three carbon atoms, and $R_3$ is H, an alkyl group or $—C(OH)R_1R_2$.

2. The plating bath of claim 1 wherein the bath comprises a mixture of stannous and lead ions and at least one compound selected from the group consisting of fluoborates, fluosilicates, sulfamates, or mixtures thereof.

3. The plating bath of claim 1 wherein the bath-soluble metal salts (A) comprise salts of at least one alkane sulfonic acid, or alkanol sulfonic acid, or mixtures thereof.

4. The plating bath of claim 1 wherein $R_3$ in Formula I is $—C(OH)R_1R_2$ and $R_1$ and $R_2$ are each independently lower alkyl groups.

5. The plating bath of claim 1 also containing (C) at least one surfactant.

6. The plating bath of claim 5 wherein at least one surfactant is a cationic surfactant.

7. The plating bath of claim 1 also containing (D) an effective amount of at least one primary brightener selected from the group of aromatic aldehydes and aromatic ketones.

8. A method of electrodepositing tin, lead or tin-lead alloy on a substrate which comprises electroplating said substrate with the aqueous plating bath of claim 1.

9. An aqueous tin, lead, or tin-lead alloy electroplating bath free of fluoride and fluoborate ions comprising (A) at least one bath-soluble metal salt selected from the group consisting of a stannous salt, a lead salt, or a mixture of stannous and lead salts;

(B) at least one alpha-acetylenic alcohol or glycol of the formula $$R_1R_2C(OH)C{\equiv}CR_3 \quad (I)$$

wherein $R_1$ and $R_2$ are each independently H, an alkyl group, a cycloalkyl group or $R_1$ and $R_2$ together with the carbon atom form a cyclic group, provided that at least one of $R_1$ and $R_2$ is an alkyl group containing at least three carbon atoms, and $R_3$ is H, an alkyl group or $—C(OH)R_1R_2$; and (C) at least one surfactant.

10. The plating bath of claim 9 wherein the bath-soluble salts (A) comprise salts of at least one alkane sulfonic acid or alkanol sulfonic acid, or mixtures thereof.

11. The plating bath of claim 9 wherein $R_3$ in Formula I is $—C(OH)R_1R_2$ wherein $R_1$ and $R_2$ are each independently lower alkyl groups.

12. The plating bath of claim 9 containing at least one cationic surfactant.

13. The plating bath of claim 12 wherein at least one cationic surfactant is characterized by the formula $$R_4(—\underset{\displaystyle (R_5O)_zH}{\underset{|}{N}}—R—)_a—N\begin{matrix}(R_6O)_xH\\(R_7O)_yH\end{matrix} \quad (II)$$

wherein $R_4$ is a fatty acid alkyl group containing about 8 to about 22 carbon atoms;

R is an alkylene group containing up to about 5 carbon atoms;

$R_5$, $R_6$ and $R_7$ are each independently an ethylene or propylene group;

a is 0 or 1; and x, y and z are each independently integers from 1 to about 30, and the sum of x, y and z is from 2 to about 50.

14. The plating bath of claim 9 also containing (E) at least one alkane sulfonic acid or alkanol sulfonic acid.

15. The plating bath of claim 14 wherein the alkane sulfonic acid and alkanol sulfonic acid are characterized by the respective formulae $$RSO_3H \quad (IX)$$

$$C_nH_{2n+1}CH(OH)—(CH_2)_mSO_3H \quad (X)$$

wherein

R is an aliphatic group containing from 1 to about 12 carbon atoms;

n is from 0 to about 10;

m is from 1 to about 11; and the sum of m+n is up to about 12.

16. A method of electrodepositing tin, lead or tin-lead alloy on a substrate which comprises electroplating said substrate with the aqueous plating bath of claim 9.

17. An aqueous tin, lead, or tin-lead alloy electroplating bath free of fluoride and borofluoride ions comprising (A) at least one bath-soluble metal salt selected from the group consisting of a stannous salt, a lead salt, or a mixture of stannous and lead salts;

(B) at least one alpha-acetylenic glycol represented by the formula $$R_1R_2C(OH)C{\equiv}C—C(OH)R_1R_2 \quad (IA)$$

wherein each $R_1$ and $R_2$ are independently hydrogen or lower alkyl groups, provided that at least one of $R_1$ and $R_2$ contains at least three carbon atoms;

(C) at least one surfactant; and (E) at least one alkane sulfonic acid or alkanol sulfonic acid.

18. The plating bath of claim 17 wherein the bath-soluble metal salts (A) comprise the salts of at least one alkane sulfonic acid or alkanol sulfonic acid and mixtures thereof.

19. The plating bath of claim 17 wherein $R_1$ and $R_2$ in Formula IA are lower alkyl groups.

20. The plating bath of claim 17 containing at least one cationic and at least one anionic surfactant.

21. The plating bath of claim 20 wherein the cationic surfactant (C) is characterized by the formula

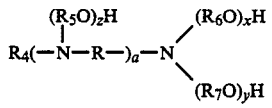

(II)

wherein $R_4$ is a fatty acid alkyl group containing about 8 to about 22 carbon atoms;

R is an alkylene group containing up to about 5 carbon atoms;

$R_5$, $R_6$ and $R_7$ are each independently an ethylene or propylene group;

a is 0 or 1; and x, y and z are each independently integers from 1 to about 30, and the sum of x, y and z is from 2 to about 50.

22. The plating bath of claim 17 wherein the alkane sulfonic acid and alkanol sulfonic acid (E) are characterized by the following formulae $$RSO_3H \quad (I)$$

$$C_nH_{2n+1}-\underset{\underset{OH}{|}}{CH}-(CH_2)_m-SO_3H \quad (II)$$

respectively where R is an aliphatic group containing from 1 to about 12 carbon atoms, n is from 0 to about 10, m is from 1 to about 11, and the sum of m+n is up to about 12.

23. A method of electrodepositing tin, lead or tin-lead alloy on a substrate which comprises electroplating said substrate with the aqueous plating bath of claim 17.

24. An aqueous plating bath for electrodeposition of a tin, lead or tin-lead alloy, which plating bath is free of fluoride and fluoborates and comprises (A) from about 0.5 to about 350 grams per liter of at least one stannous ion, lead ion or mixture of stannous and lead ions;

(B) from about 1 to about 10 grams per liter of at least one alpha acetylenic glycol represented by the formula $$R_1R_2C(OH)C{\equiv}C-C(OH)R_1R_2 \quad (IA)$$

wherein each $R_1$ and $R_2$ are independently hydrogen or lower alkyl groups, provided that at least one of $R_1$ and $R_2$ is an alkyl group containing at least three carbon atoms;

(C) from about 0.1 to about 15 grams per liter of at least one cationic surfactant characterized by the formula

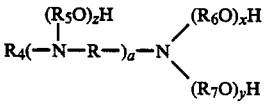

(II)

wherein $R_4$ is a fatty acid alkyl group containing about 8 to about 22 carbon atoms;

R is an alkylene group containing up to about 5 carbon atoms;

$R_5$, $R_6$ and $R_7$ are each independently an ethylene or propylene group;

a is 0 or 1; and x, y and z are each independently integers from 1 to about 30, and the sum of x, y and z is from 2 to about 50; and (E) from about 10 to about 500 grams per liter of at least one alkane sulfonic acid having the general formula $$RSO_3H \quad (I)$$

or an alkanol sulfonic acid of the general formula $$C_nH_{2n+1}-\underset{\underset{OH}{|}}{CH}-(CH_2)_m-SO_3H \quad (II)$$

where

R is an aliphatic group containing from 1 to about 6 carbon atoms, n is from 0 to about 10, m is from 1 to about 11, and the sum of m+n is up to about 12.

25. The plating bath of claim 24 also containing an effective amount of an antioxidant.

26. The plating bath of claim 25 wherein the antioxidant is catechol.

27. The plating bath of claim 24 also containing at least one anionic surfactant.

28. The plating bath of claim 27 wherein the anionic surfactant is a sulfated alkyl alcohol or an alkali metal salt of a sulfated alkyl alcohol.

29. An additive composition for aqueous tin, lead, or tin-lead electroplating baths comprising a mixture of (A) at least an alpha acetylenic alcohol or glycol of the formula $$R_1R_2C(OH)C{\equiv}CR_3 \quad (I)$$

wherein $R_1$ and $R_2$ are each independently H, an alkyl group, a cycloalkyl group or $R_1$ and $R_2$ together with the carbon atom form a cyclic group, provided that at least one of $R_1$ and $R_2$ is an alkyl group containing at least three carbon atoms; and $R_3$ is H, an alkyl group or $-C(OH)R_1R_2$;

(B) at least one alkoxylated amine surfactant of the formula

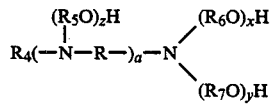

(II)

wherein $R_4$ is a fatty acid alkyl group containing about 8 to about 22 carbon atoms;

R is an alkylene group containing up to about 5 carbon atoms;

$R_5$, $R_6$ and $R_7$ are each independently an ethylene or propylene group;

a is 0 or 1; and x, y and z are each independently integers from 1 to about 30, and the sum of x, y and z is from 2 to about 50; and (C) at least one alkali metal salt of a sulfated alkyl alcohol.

* * * * *